US008064608B2

(12) United States Patent
Kakara

(10) Patent No.: US 8,064,608 B2
(45) Date of Patent: Nov. 22, 2011

(54) AUDIO DECODING TECHNIQUES FOR MID-SIDE STEREO

(75) Inventor: Satyanarayana Kakara, Hyderabad (IN)

(73) Assignee: QUALCOMM Incorporated, San Diego, CA (US)

( * ) Notice: Subject to any disclaimer, the term of this patent is extended or adjusted under 35 U.S.C. 154(b) by 1169 days.

(21) Appl. No.: 11/367,534

(22) Filed: Mar. 2, 2006

(65) Prior Publication Data

US 2007/0217617 A1 Sep. 20, 2007

(51) Int. Cl.
*H04R 5/00* (2006.01)

(52) U.S. Cl. ..... 381/22

(58) Field of Classification Search ..... 381/22, 381/1; 704/500, 501, 205, 222, 224, 203
See application file for complete search history.

(56) References Cited

U.S. PATENT DOCUMENTS

| | | | | |
|---|---|---|---|---|
| 7,020,603 | B2 * | 3/2006 | Lopez-Estrada | 704/200.1 |
| 7,283,967 | B2 * | 10/2007 | Nishio et al. | 704/500 |
| 2003/0088328 | A1 * | 5/2003 | Nishio et al. | 700/94 |
| 2004/0267543 | A1 * | 12/2004 | Ojanpera | 704/500 |
| 2005/0096765 | A1 * | 5/2005 | Rao et al. | 700/94 |
| 2005/0157884 | A1 | 7/2005 | Eguchi | |
| 2005/0283370 | A1 * | 12/2005 | Mpr | 704/501 |
| 2006/0047521 | A1 * | 3/2006 | Feng et al. | 704/500 |

FOREIGN PATENT DOCUMENTS

| | | | |
|---|---|---|---|
| JP | 199475590 | | 3/1994 |
| JP | 2001282290 | A | 10/2001 |
| JP | 2004246224 | A | 9/2004 |
| JP | 2005141121 | A | 6/2005 |

OTHER PUBLICATIONS

Anguita, et al, "MP3 Optimization Exploiting Processor Architecture and Using Better Algorithms" IEEE Micro, IEEE Service Center, Los Alamitos, CA, vol. 25, No. 3, May 2005, pp. 81-92.
Yoon, et al, "Efficient DSP Architecture for High-Quality Audio Algorithms", Circuits and Systems, IEEE International Symposium on Kobe, Japan, May 2005, pp. 2947-2950.
Ruimin, et al., "AVS Generic Audio Coding", Parallel and Distributed Computing, Applications and Technologies, Dec. 2005, pp. 679-683.
Shamshiri, et al., "Parallel Alias Reduction for MP3 Decoding", Microelectronics, The 16th International Conference on Tunis, Tunisia, Dec. 2004, pp. 438-441.

(Continued)

*Primary Examiner* — Curtis Kuntz
*Assistant Examiner* — Hai Phan
(74) *Attorney, Agent, or Firm* — Alexander Chen; Espartaco Diaz Hidalgo

(57) ABSTRACT

This disclosure describes decoding techniques for audio information encoded according to mid-side (MS) stereo encoding. The techniques involve a number of audio decoding tasks that are performed in a non-conventional order. By rearranging the order of the decoding tasks, various efficiencies can be achieved. In one embodiment, a method of decoding MS stereo audio information includes decoding a first channel of the audio information, computing an inverse modified discrete cosine transform (IMDCT) for the first channel prior to generating MS stereo information, decoding the second channel of the audio information, computing an IMDCT for the second channel prior to generating the MS stereo information, and generating the MS stereo information using the IMDCTs for the first and second channels.

26 Claims, 4 Drawing Sheets

OTHER PUBLICATIONS

Kwon, et al., "Real-Time Implementation of MPEG-1 Layer III Audio Decoder with TMS320C6201 DSP", Signal Processing Systems, Oct. 2000, pp. 761-770.

International Search Report and Written Opinion—PCT/US2007/063228, International Search Authority—European Patent Office—May 7, 2007.

* cited by examiner

AUDIO DECODING TECHNIQUES FOR MID-SIDE STEREO

TECHNICAL FIELD

This disclosure relates to audio coding techniques and, more particularly, decoding techniques for audio information encoded according to mid-side (MS) stereo encoding techniques.

BACKGROUND

Audio coding is used in many applications and environments such as satellite radio, digital radio, internet streaming (web radio), digital music players, and a variety of mobile multimedia applications. There are many audio coding standards, such as standards according to the motion pictures expert group (MPEG), windows media audio (WMA), and standards by Dolby Laboratories, Inc. Many audio coding standards continue to emerge, including the MP3 standard and successors to the MP3 standard, such as the advanced audio coding (AAC) standard used in "iPod" devices sold by Apple Computer, Inc. Audio coding standards generally seek to achieve low bitrate, high quality audio coding using compression techniques. Some audio coding is "loss-less", meaning that the coding does not degrade the audio signal, while other audio coding may introduce some loss in order to achieve additional compression.

In many applications, audio coding is used with video coding in order to provide multi-media content for applications such as video telephony (VT) or streaming video. Video coding standards according to the MPEG, for example, often use audio and video coding. The MPEG standards currently include MPEG-1, MPEG-2 and MPEG-4, but other standards will likely emerge. Other exemplary video standards include the International Telecommunications Union (ITU) H.263 standards, ITU H.264 standards, QuickTime™ technology developed by Apple Computer Inc., Video for Windows™ developed by Microsoft Corporation, Indeo™ developed by Intel Corporation, RealVideo™ from RealNetworks, Inc., and Cinepak™ developed by SuperMac, Inc. Some audio and video standards are open source, while others remain proprietary. Many other audio and video coding standards will continue to emerge and evolve.

Stereo coding refers to audio coding that uses two different coding channels. Since humans have two ears, which can detect sound in a directional fashion, stereo coding can improve the quality of perceived sound that is detected by humans from a decoded audio signal. One relatively intuitive way to encode stereo sound information is to use left and right channels to code left and right signals respectively. However, for complex sound such as musical recordings, left and right encoding channels do not work particularly well, due to the fact that left and right microphones can detect the same sounds at different time delays. For this reason, mid-side (MS) stereo was developed to improve stereo sound quality.

In MS stereo, two different signals are used to respectively code the location of sound sources and the reverberant ambiance of the stereo image. Basically, MS stereo is encoded via a middle signal and a side signal. Following decode, a left channel is generally the sum of two coded channels, while the right channel is generally the difference between the two coded channels. By using a middle stereo component and a side stereo component, stereo redundancies in left and right channels can be exploited to achieve better quality stereo coding, as well as better levels of compression for a given level of quality.

SUMMARY

This disclosure describes decoding techniques for audio information encoded according to mid-side (MS) stereo encoding. The techniques involve a number of audio decoding tasks that are performed in a non-conventional order. By rearranging the order of the decoding tasks, various efficiencies can be achieved. For example, latency in the decoding process can be eliminated or reduced by allowing computational tasks for inverse modified discrete cosine transforms (IMDCTs) on a first channel to be performed in parallel with pre-decoding tasks on a second channel. In particular, when used with direct memory exchange (DME) technology, the techniques can allow memory fetches to load decoding tables (such as Huffman tables) used in the decoding of one channel in parallel with IMDCT computations on the other channel. In this manner, the techniques provide computational advantages and may accelerate the audio decoding process.

In one embodiment, this disclosure provides a device comprising a memory that stores encoded audio information, and a decoder unit that decodes the information. The decoder unit decodes a first channel of the audio information, computes an IMDCT for the first channel prior to generating MS stereo information, decodes the second channel of the audio information, computes an IMDCT for the second channel prior to generating the MS stereo information, and generates MS stereo information using the IMDCTs for the first and second channels.

In another embodiment, this disclosure provides a method of decoding MS stereo audio information. The method comprises decoding a first channel of the audio information, computing an IMDCT for the first channel prior to generating MS stereo information, decoding the second channel of the audio information, computing an IMDCT for the second channel prior to generating the MS stereo information, and generating the MS stereo information using the IMDCTs for the first and second channels. In order to exploit this technique, memory fetches to load decoding tables for the second channel can be performed during the IMDCT computation for the first channel.

These and other techniques described herein may be implemented in a hardware, software, firmware, or any combination thereof. If implemented in software, the software may be executed in a digital signal processor (DSP) or other type of processor. The software that executes the techniques may be initially stored in a computer readable medium and loaded and executed in the DSP for effective audio decoding of audio information that was encoded according to MS stereo.

Accordingly, this disclosure also contemplates a computer readable medium comprising executable instructions that upon execution in a device that supports MS stereo, decode a first channel of audio information, compute an IMDCT for the first channel prior to generating MS stereo information, decode the second channel of the audio information, compute an IMDCT for the second channel prior to generating the MS stereo information, and generate the MS stereo information using the IMDCTs for the first and second channels.

In yet another embodiment, this disclosure provides a decoder unit for an audio decoding device, wherein the decoder unit decodes a first channel of audio information, computes a transform for the first channel prior to generating MS stereo information, decodes the second channel of the audio information, computes a transform for the second channel prior to generating the MS stereo information, and generates the MS stereo information using the transforms for the first and second channels.

Additional details of various embodiments are set forth in the accompanying drawings and the description below. Other features, objects and advantages will become apparent from the description and drawings, and from the claims.

DETAILED DESCRIPTION

This disclosure describes decoding techniques for audio information encoded according to mid-side (MS) stereo encoding. In MS stereo, two different signals are used to respectively code the location of sound sources and the reverberant ambiance of the stereo image. Basically, MS stereo is encoded from a middle signal and a side signal. Following a decode of MS stereo, a left channel is generally the sum of first and second encoded channels, while the right channel is generally the difference between the first and second encoded channels. The left and right channels could also be reversed.

Conventional MS stereo decoding involves a decode of channel 1 followed by dequantization of that channel. Next, channel 2 is decoded followed by dequantization of that channel. Stereo information for left and right channels are then computed from the decoded channels 1 and 2. For example, the left channel MS stereo information may comprise Channel 1 +Channel 2, and the right channel MS stereo information may comprise Channel 1−Channel 2. Next, an inverse modified discrete cosine transform (IMDCT) is performed with respect to the left channel stereo information, windowing is performed, and audio samples are rendered for the left channel. Similarly, an IMDCT is performed with respect to the right channel stereo information, windowing is performed, and audio samples are rendered for the right channel. In this manner, conventional MS stereo decoding is generally a sequential process in which IMDCT follows the generation of MS stereo information.

The techniques described in this disclosure may include steps similar to conventional MS stereo decoding, but perform the steps in a non-conventional order. Specifically, in accordance with this disclosure, the IMDCT is performed with respect to channel 1 and channel 2 prior to generation of MS stereo information for left and right channels. By rearranging the order of the decoding tasks, various efficiencies can be achieved. For example, latency in the decoding process can be eliminated or reduced by allowing computational tasks for IMDCTs on a first channel to be performed in parallel with pre-decoding tasks on a second channel. In particular, when used with direct memory exchange (DME) technology in a digital signal processor (DSP), the techniques can allow memory fetches of decoding tables for one channel to be performed in parallel with IMDCT computations on the other channel. In this manner, the techniques described herein can provide computational advantages and may accelerate the audio decoding process.

DME technology generally refers to DSP-executed memory fetches that are performed in parallel with processing by the DSP during a clock cycle of the DSP. Other types of memory or processing techniques might also be used, particularly any techniques that support the ability to perform parallel memory loads into an on-chip processor location during computational tasks of the processor.

Figure 1:
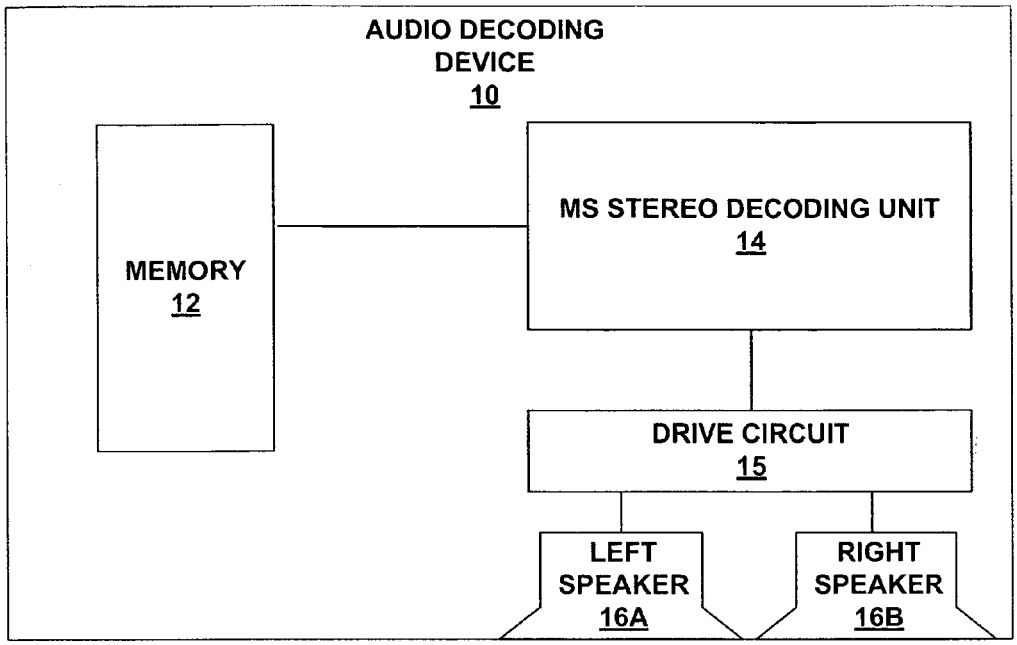
FIG. 1 is a block diagram of an example audio decoding device that can implement the techniques of this disclosure.

FIG. 1 is a block diagram of an audio decoding device 10, which can implement the techniques of this disclosure. As shown, device 10 includes a memory 12 and an MS stereo decoding unit 14. Memory 12 may store audio information that has been encoded according to MS stereo. The audio information may have been received over a communication channel, such as with real-time audio, or may have been stored for an extended period in memory 12. Decoding unit 14 performs one or more of the techniques of this disclosure, in order to improve the decoding process of the audio information. In particular, decoding unit 14 decodes a first channel of the audio information, computes an IMDCT for the first channel prior to generating MS stereo information, decodes the second channel of the audio information, computes an IMDCT for the second channel prior to generating the MS stereo information, and generates the MS stereo information using the IMDCTs for the first and second channels. The MS stereo information can then be used to generate signals that can drive left and right speakers 16A and 16B. In particular, a drive circuit 15 may receive the MS stereo information from MS stereo decoding unit 14 and generate driving voltages for speakers 16A and 16B based on the MS stereo information. Drive circuit 15 may include one or more digital-to-analog converters (DACs), power amplifiers and other analog signal conditioning components.

A "bottleneck" in MS decoding can occur due to the fact that conventional MS decoding requires both coded channels to be decoded and MS stereo information to be generated prior to performing IMDCT. According to this disclosure, however, IMDCT for each coded channel (channels 1 and 2) can be performed prior to generation of the MS stereo information for left and right channels. An observed linearity property of IMDCT makes this change possible.

Furthermore, by rearranging the steps of the decoding process, efficiencies can be achieved by utilizing parallel processing. For example, latency in the decoding process can be eliminated or reduced by allowing decoding unit 14 to perform IMDCTs on a first channel in parallel with pre-decoding tasks for a second channel. In particular, when used with DME technology or similar technology that supports memory fetches during computations, the techniques can allow decoding unit 14 to perform memory fetches from memory 12 in parallel with IMDCT computations. The memory fetches can load decoding tables (such as Huffman tables) to be used in the decoding of one channel. At the same time, IMDCT computations can be executed for the other channel. In this manner, decoding unit 14 can achieve computational efficiencies and the audio decoding process can be accelerated.

Device 10 may comprise any of a wide variety of devices that can include audio decoding capabilities. Examples include digital music players such as iPods, digital televisions, digital direct broadcast systems, wireless communication devices, personal digital assistants (PDAs), laptop computers, desktop computers, digital cameras, digital recording devices, cellular or satellite radio telephones, direct two-way communication devices (sometimes referred to as "walkie-talkies"), and the like.

Figure 2:
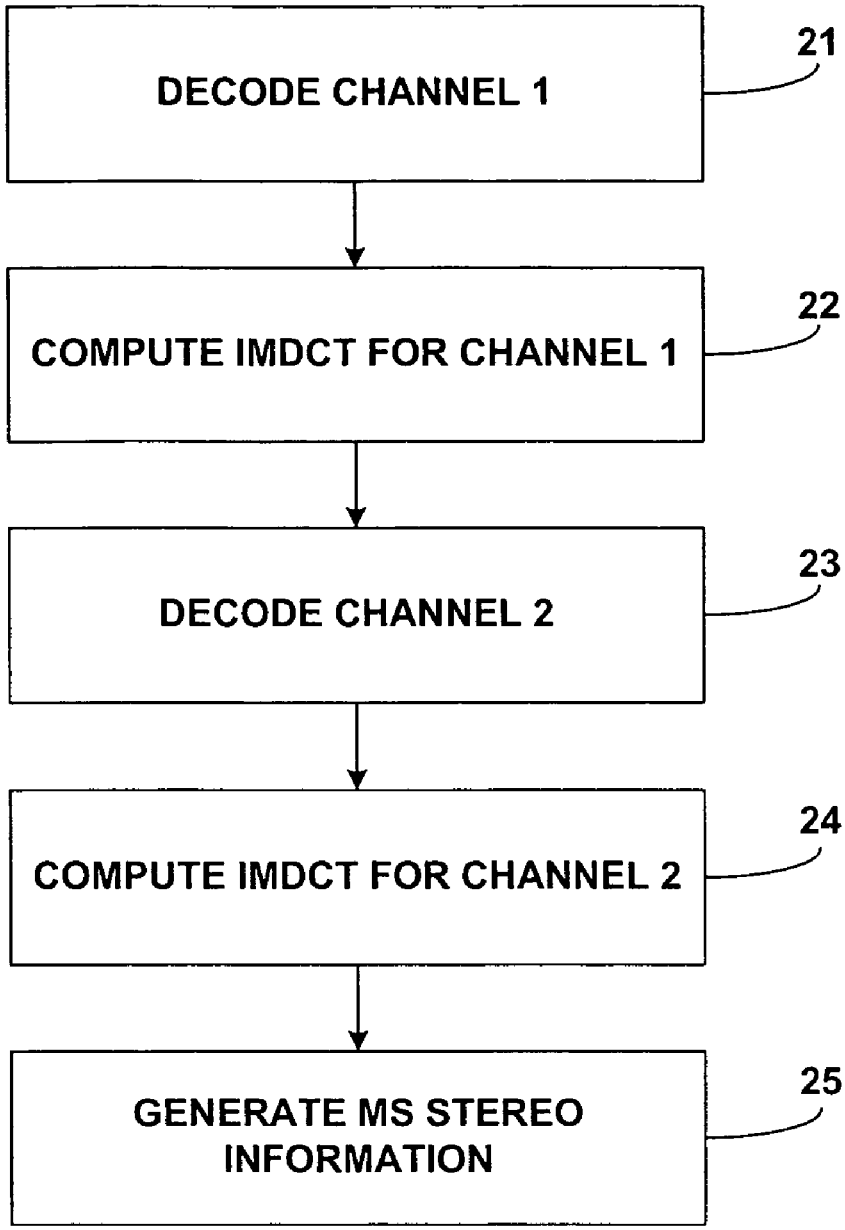
FIGS. 2-4 are flow diagrams illustrating techniques that may be performed by the audio decoding device of FIG. 1 or other similar devices.

FIG. 2 is a flow diagram illustrating a decoding process that may be implemented by decoding unit 14. As shown, decoding unit 14 decodes a first channel of the audio information (21), and then computes an IMDCT for the first channel (22) prior to generating MS stereo information (25). Next, decoding unit 14 decodes the second channel of the audio information (23), and computes an IMDCT for the second channel (24) prior to generating MS stereo information (25).

The calculations of the IMDCTs for the first and second channels may conform substantially to the following equations 1 and 2:

$$\text{L_channel_time_output}' = \frac{2}{N} \times \sum_{k=0}^{\frac{N}{2}-1} L[k]\cos\left(\frac{2\pi}{N}(n+n_0)\left(k+\frac{1}{2}\right)\right) \quad \text{(Equation 1)}$$

$$\text{R_channel_time_output}' = \frac{2}{N} \times \sum_{k=0}^{\frac{N}{2}-1} R[k]\cos\left(\frac{2\pi}{N}(n+n_0)\left(k+\frac{1}{2}\right)\right) \quad \text{(Equation 2)}$$

where L_channel_time_output' represents the IMDCT for channel 1,

R_channel_time_output' represents the IMDCT for channel 2,

L and R represent the left and right channel spectral coefficients, respectively, N represents the audio frame length in decoder unit 14, K represents a spectral coefficients frequency index, n represents a time index, and $n_0$ is a constant.

In other embodiments, however, decoder unit 14 could possibly use other types of transforms rather than IMDCTs.

As illustrated in FIG. 2, decoding unit generates MS stereo information using the IMDCTs for the first and second channels (25). The MS stereo information comprises left and right channel information that can be used to generate audio samples, which in turn can be used to define drive signals for left and right speakers 16A and 16B. Again, the left channel information may be the additive combination of IMDCTs from channels 1 and 2, while the right channel information may be the subtractive combination of IMDCTs for channels 1 and 2. The right and left channels, however, could be reversed and defined such that the left channel is the additive combination of IMDCTs and the right channel is the subtractive combination of IMDCTs. Notably, the generation of MS stereo information occurs after the IMDCT computations.

In most cases, decoding unit 14 may also perform dequantization on the first and second channels. Specifically, decoding unit 14 may perform dequantization on the first channel of the audio information prior to computing the IMDCT for the first channel, and may perform dequantization on the second channel of the audio information prior to computing the IMDCT for the second channel.

In some cases, the decoding of the first and second channels may comprise Huffman decoding or other similar decoding that uses lookup tables. In such cases, lookup tables (e.g., Huffman tables) may need to be loaded from memory 12 into decoding unit 14 for each of the coded channels, and possibly reloaded for successive audio frames. Unfortunately, Huffman tables can be relatively large, particularly if decoding unit 14 is implemented as a DSP that does not include large on-chip memory. In accordance with this disclosure, a Huffman table for the first channel can be loaded from memory 12 into decoding unit 14 prior to the decoding of the first channel, and a Huffman table for the second channel can be loaded from memory 12 into decoding unit 14 while computing the IMDCT for the second channel. Decoding unit 14 may comprise a DSP with local on-chip memory sufficient to store a Huffman table, yet insufficient to store several such tables.

Parallel memory loads while performing MDCT computations are particularly useful if decoding unit 14 comprises a DSP that supports direct memory exchanges (DMEs). In this case, the DSP can perform memory fetches to load the next Huffman table needed for the next channel decode, while simultaneously performing the IMDCT computations for the current channel. Moreover, successive parallel computations and memory fetches can be performed for successive audio frames. In particular, when the audio information is broken into a plurality of audio frames of an audio sequence, decoding unit 14 may load a Huffman table for the first channel of a first audio frame prior to decoding the first channel of the first audio frame, load a Huffman table for the second channel of the first audio frame while computing the IMDCT for the second channel of the first audio frame, and load a Huffman table for a first channel of a second audio frame while computing the IMDCT for the second channel of the first audio frame. In this manner, simultaneous computations and memory fetches can be performed with the decode of each channel of successive audio frames.

Figure 3:
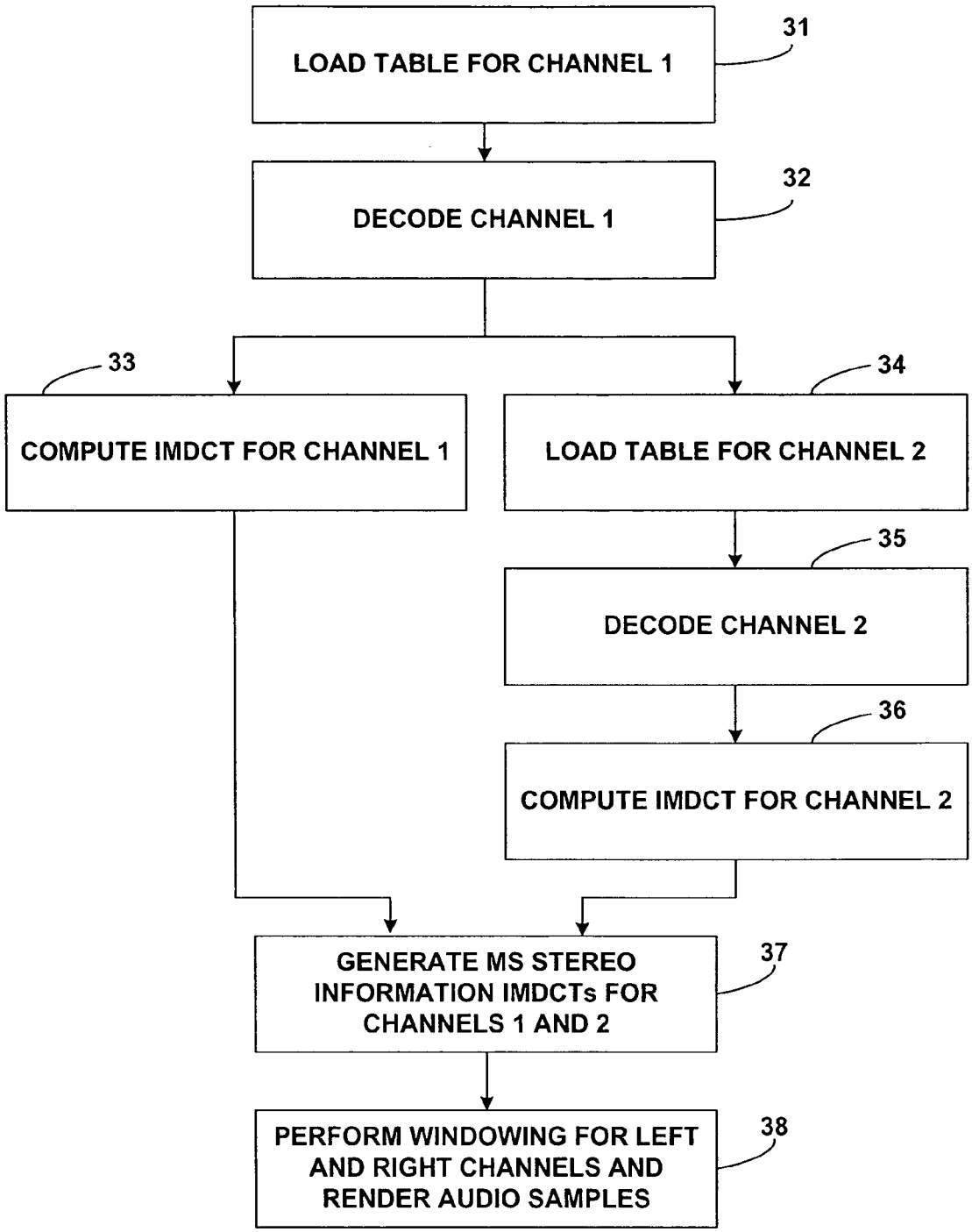

FIG. 3 is another flow diagram illustrating aspects of an audio decoding process according to this disclosure. As shown in FIG. 3, decoding unit 14 loads a lookup table from memory 12 for channel 1 (31), e.g., via a direct memory access (DMA), and then proceeds to decode channel 1 (32), e.g., using the loaded lookup table. Decoding unit 14 then computes the IMDCT for channel 1 (33), while simultaneously loading a different lookup table from memory 12 for channel 2, e.g., via a direct memory exchange (DME) (34). Decoding unit 14 can then decode channel 2 (35) and compute the IMDCT for channel 2 (36).

Decoding unit then generates the MS stereo information channels 1 and 2 using the IMDCTs for the channels (35). The MS stereo information comprises left and right channel information that can be used to generate audio samples, which in turn can be used to define drive signals for left and right speakers 16A and 16B. As noted above with respect to FIG. 2, decoding unit 14 may also perform dequantization on channels 1 and 2, e.g., prior to the respective IMDCT computations for each channel. In any case, the generation of MS stereo information (37) occurs after the IMDCT computations (33 and 36). Decoding unit 14 can then perform windowing for the left and right channels and render audio samples (38). The audio samples, may be used by a drive circuit 15 to define voltages needed to drive speakers 16A and 16B for stereo output.

Figure 4:
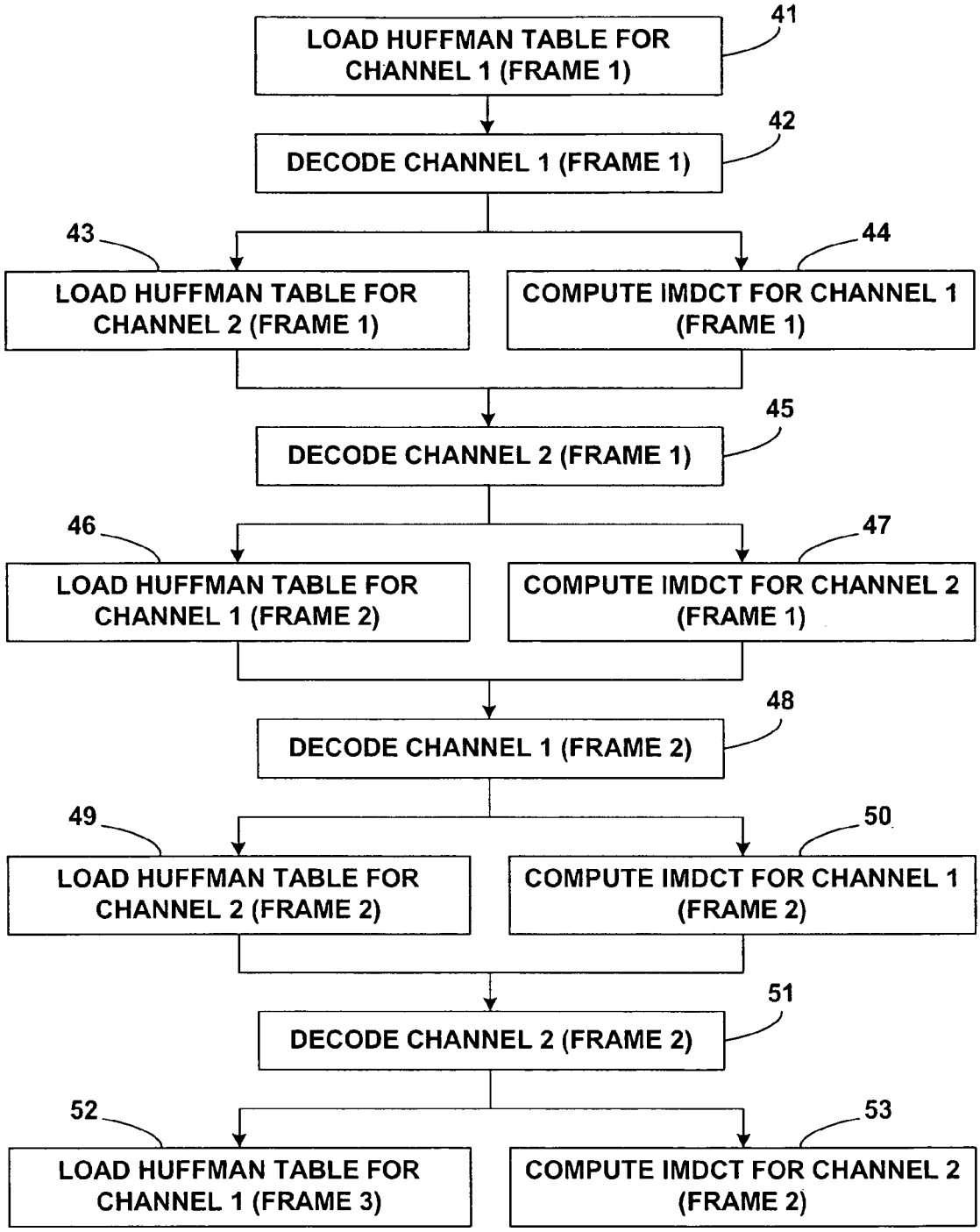

Again, in accordance with this disclosure, simultaneous computations of IMDCTs with the DME loads of the next lookup table to be used in the decoding may occur repeatedly for channels 1 and 2 of successive audio frames of an audio sequence. FIG. 4 illustrates this advantageous technique in the context of Huffman decoding for a sequence of audio frames.

As shown in FIG. 4, decoding unit 14 loads a Huffman table from memory 12 for channel 1 of the first frame of an audio sequence (41), e.g., via a DMA. Decoding unit 14 then decodes channel 1 using the loaded Huffman table (42). Decoding unit 14 then computes the IMDCT for channel 1 of the first frame (44), while simultaneously loading a different Huffman table from memory 12 for channel 2 of the first frame, e.g., via a DME (43). Decoding unit 14 can then decode channel 2 of the first frame using the Huffman table loaded during the IMDCT computation for channel 1 of the first frame (45).

Next, decoding unit computes the IMDCT for channel 2 of the first frame (47), while simultaneously loading a different Huffman table from memory 12 for channel 1 of the second frame of the audio sequence, e.g., via a DME (46). Decoding unit 14 can then decode channel 1 of the second frame using the Huffman table loaded during the IMDCT computation for channel 2 of the first frame (48).

Next, decoding unit 14 computes the IMDCT for channel 1 of the second frame (50), while simultaneously loading a different Huffman table from memory 12 for channel 2 of the second frame of the audio sequence, e.g., via a DME (49). Decoding unit 14 can then decode channel 2 of the second frame using the Huffman table loaded during the IMDCT computation for channel 1 of the second frame (51).

Next, decoding unit 14 computes the IMDCT for channel 2 of the second frame (53), while simultaneously loading a different Huffman table from memory 12 for channel 1 of the third frame of the audio sequence, e.g., via a DME (49). This process can continue for any number of MS coded audio frames of an audio sequence. With each subsequent IMDCT computation, a simultaneous memory fetch and load of the next needed Huffman table can be performed to reduce latency and accelerate the decoding process.

A number of embodiments have been described. However, various modifications could be made to the techniques described herein. For example, MS stereo could consist of two channels, or could refer to two channels of a multi-channel system such as a multi-channel surround sound system. In addition, other types of transforms might be used for MS stereo decoding, rather than IMDCTs. Also, although the disclosure has referred to Huffman tables for Huffman coding, other types of coding could be used according to this discourse. Huffman coding is a useful example because it results in loss-less encoding and decoding of audio information. Other coding techniques, particularly lookup coding techniques that require loads from memory for each channel of successive audio frames, may also benefit from the teaching of this disclosure.

The techniques described herein may be implemented in hardware, software, firmware, or any combination thereof. If implemented in software, the techniques may be directed to a computer readable medium comprising program code, that when executed in a device that codes video sequences, performs one or more of the audio decoding techniques described herein. In that case, the computer readable medium may comprise random access memory (RAM) such as synchronous dynamic random access memory (SDRAM), read-only memory (ROM), non-volatile random access memory (NVRAM), electrically erasable programmable read-only memory (EEPROM), FLASH memory, and the like.

The program code may be stored on memory in the form of computer readable instructions. In that case, a processor such as a DSP may execute instructions stored in memory in order to carry out one or more of the audio decoding techniques. In some cases, the techniques may be executed by a DSP that invokes various hardware components to accelerate the coding process. In other cases, the units described herein may be implemented as a microprocessor, one or more application specific integrated circuits (ASICs), one or more field programmable gate arrays (FPGAs), or some other hardware-software combination.

These and other embodiments are within the scope of the following claims.

The invention claimed is:

1. A device comprising:

a memory to store encoded audio information; and a decoder unit to decode the encoded information, wherein the decoder unit is operable to:

decode a first channel of the audio information;

compute an inverse modified discrete cosine transform (IMDCT) for the first channel prior to calculating mid-side (MS) stereo information;

decode a second channel of the audio information;

compute an IMDCT for the second channel prior to calculating the MS stereo information;

calculate the MS stereo information using the IMDCTs for the first and second channels, wherein the MS stereo information comprises left channel information and right channel information, and wherein the left channel information is calculated using the IMDCT for the first channel and the IMDCT for the second channel, and the right channel information is calculated using the IMDCT for the first channel and the IMDCT for the second channel; and output the MS stereo information.

2. The device of claim 1, wherein the decoder unit is operable to:

perform dequantization on the first channel of the audio information prior to computing the IMDCT for the first channel; and perform dequantization on the second channel of the audio information prior to computing the IMDCT for the second channel.

3. The device of claim 1, further comprising left and right stereo speakers, wherein the decoder unit is operable to perform windowing on the left and right channel information and render audio samples for the left and right stereo speakers.

4. The device of claim 1, wherein decoding the first channel comprises Huffman decoding the first channel, and wherein decoding the second channel comprises Huffman decoding the second channel.

5. The device of claim 4, wherein the decoding unit is operable to load a Huffman table for the first channel prior to decoding the first channel, and load a Huffman table for the second channel while computing the IMDCT for the first channel.

6. The device of claim 1, wherein the decoding unit is operable to decode the first and second channels for a plurality of audio frames of an audio sequence.

7. The device of claim 6, wherein the decoding unit is operable to perform Huffman decoding, wherein the decoding unit is operable to load a Huffman table for the first channel of the first audio frame prior to decoding the first channel of the first audio frame, load a Huffman table for the second channel of the first audio frame while computing the IMDCT for the first channel of the first audio frame, and load a Huffman table for a first channel of a second audio frame while computing the IMDCT for the second channel of the first audio frame.

8. The device of claim 1, wherein the decoding unit comprises a digital signal processor DSP that supports direct memory exchanges (DMEs).

9. The device of claim 1, wherein the device comprises at least one of a digital music player, a wireless communication device, a personal digital assistant (PDA), a laptop computer, a desktop computer, a digital camera, a digital video recording device, a radio telephone and a direct two-way communication device.

10. A method of decoding mid-side (MS) stereo audio information, the method comprising:

decoding a first channel of the audio information;

computing an inverse modified discrete cosine transform (IMDCT) for the first channel prior to calculating MS stereo information;

decoding a second channel of the audio information;

computing an IMDCT for the second channel prior to calculating the MS stereo information;

calculating the MS stereo information using the IMDCTs for the first and second channels, wherein the MS stereo information comprises left channel information and right channel information, and wherein the left channel information is calculated using the IMDCT for the first channel and the IMDCT for the second channel, and the right channel information is calculated using the IMDCT for the first channel and the IMDCT for the second channel; and outputting the MS stereo information.

11. The method of claims 10, further comprising:

performing dequantization on the first channel of the audio information prior to computing the IMDCT for the first channel; and performing dequantization on the second channel of the audio information prior to computing the IMDCT for the second channel.

12. The method of claim 10, further comprising performing windowing on the left and right channel information and rendering audio samples for left and right stereo speakers.

13. The method of claim 10, wherein decoding the first channel comprises Huffman decoding the first channel and wherein decoding the second channel comprises Huffman decoding the second channel.

14. The method of claim 13, further comprising loading a Huffman table for the first channel prior to decoding the first channel, and loading a Huffman table for the second channel while computing the IMDCT for the first channel.

15. The method of claim 10, further comprising decoding the first and second channels for a plurality of audio frames of an audio sequence.

16. The method of claim 15, wherein decoding the first and second channels comprises Huffman decoding the first and second channels, wherein the decoding unit loads a Huffman table for the first channel of the first audio frame prior to decoding the first channel, loads a Huffman table for the second channel of the first audio frame while computing the IMDCT for the first channel of the first audio frame, and loads a Huffman table for a first channel of a second audio frame while computing the IMDCT for the second channel of the first audio frame.

17. A non-transitory computer readable medium comprising executable instructions that upon execution in a device that supports mid-side (MS) stereo:

decode a first channel of audio information;

compute an inverse modified discrete cosine transform (IMDCT) for the first channel prior to calculating MS stereo information;

decode a second channel of the audio information;

compute an IMDCT for the second channel prior to calculating the MS stereo information;

calculate MS stereo information using the IMDCTs for the first and second channels, wherein the MS stereo information comprises left channel information and right channel information, and wherein the left channel information is calculated using the IMDCT for the first channel and the IMDCT for the second channel, and the right channel information is calculated using the IMDCT for the first channel and the IMDCT for the second channel; and output the MS stereo information.

18. The non-transitory computer readable medium of claim 17, further comprising instructions that:

perform dequantization on the first channel of the audio information prior to computing the IMDCT for the first channel; and perform dequantization on the second channel of the audio information prior to computing the IMDCT for the second channel.

19. The non-transitory computer readable medium of claim 17, wherein the instructions perform windowing on the left and right channel information and render audio samples for left and right stereo speakers.

20. The non-transitory computer readable medium of claim 17, wherein the instructions decode the first channel using Huffman decoding and wherein the instructions decode the second channel using Huffman decoding.

21. The non-transitory computer readable medium of claim 20, wherein the instructions load a Huffman table for the first channel prior to decoding the first channel, and load a Huffman table for the second channel while computing the IMDCT for the first channel.

22. The non-transitory computer readable medium of claim 17, wherein the instructions decode the first and second channels for a plurality of audio frames of an audio sequence.

23. The non-transitory computer readable medium of claim 22, wherein the instructions use Huffman decoding, wherein the instructions load a Huffman table for the first channel of the first audio frame prior to decoding the first channel of the first audio frame, load a Huffman table for the second channel of the first audio frame while computing the IMDCT for the first channel of the first audio frame, and load a Huffman table for a first channel of a second audio frame while computing the IMDCT for the second channel of the first audio frame.

24. A decoder unit for an audio decoding device, wherein the decoder unit is operable to:

decode a first channel of audio information;

compute a transform for the first channel prior to calculating mid-side (MS) stereo information;

decode a second channel of the audio information;

compute a transform for the second channel prior to calculating the MS stereo information;

calculate the MS stereo information using the transforms for the first and second channels, wherein the MS stereo information comprises left channel information and right channel information, and wherein the left channel information is calculated using the transform for the first channel and the transform for the second channel, and the right channel information is calculated using the transform for the first channel and the transform for the second channel; and output the MS stereo information.

25. The decoder unit of claim 24, wherein the transforms for the first and second channels comprise inverse modified discrete cosine transforms (IMDCTs).

26. The decoder unit of claim 24, wherein the decoder unit is operable to load a table for the decode of the first channel prior to decoding the first channel, and load a table for the second channel while computing the transform for the first channel.

* * * * *